US005704947A

United States Patent [19]

Kaiser et al.

[11] Patent Number: 5,704,947

[45] Date of Patent: Jan. 6, 1998

[54] USE OF WATER-SOLUBLE POLYMERS AND POLYHYDROXYMONO- OR DICARBOXYLATES IN THE BLEACHING OF TEXTILES

[76] Inventors: Heribert Kaiser, Lorettostr. 18, 40219 Duesseldorf; Christian Nitsch, Otto-Hahn-Str. 185, 40591 Duesseldorf; Claus-Peter Kurzendoerfer, Corellistr. 80, 40593 Duesseldorf; Bernd Wahle, Am Heidt 24, 41564 Kaarst; Bernd-Dieter Baehr, deceased, late of 41466 Neuss; Sylvia Baehr, executrix, Gillbachstr. 27, 41466 Neuss; Hildegard Van Delden, Zur Verlach 50, 40723 Hilden, all of Germany

[21] Appl. No.: 737,368

[22] PCT Filed: Apr. 29, 1995

[86] PCT No.: PCT/EP95/01646

§ 371 Date: Jan. 16, 1997

§ 102(e) Date: Jan. 16, 1997

[87] PCT Pub. No.: WO95/30791

PCT Pub. Date: Nov. 16, 1995

[30] Foreign Application Priority Data

May 7, 1994 [DE] Germany ..... 44 16 208.1

[51] Int. Cl.[6] ..... D06L 3/02

[52] U.S. Cl. ..... 8/111; 510/309; 510/318; 510/247; 510/253; 252/180; 252/181

[58] Field of Search ..... 8/111; 510/309, 510/318, 247, 253; 252/180, 181

[56] References Cited

U.S. PATENT DOCUMENTS

| | | | |
|---|---|---|---|
| 4,515,597 | 5/1985 | Guth et al. | 8/107 |
| 4,711,725 | 12/1987 | Amick et al. | 210/701 |
| 4,725,281 | 2/1988 | Stehlin et al. | 8/107 |

FOREIGN PATENT DOCUMENTS

| | | |
|---|---|---|
| 112 801 | 7/1984 | European Pat. Off. . |
| 186 990 | 7/1986 | European Pat. Off. . |
| 210 952 | 2/1987 | European Pat. Off. . |
| 585 038 | 3/1994 | European Pat. Off. . |
| 23 01 627 | 10/1976 | France . |
| 20 35 047 | 1/1972 | Germany . |
| 32 04 834 | 9/1983 | Germany . |
| 33 10 351 | 9/1983 | Germany . |
| 542 313 | 11/1973 | Switzerland . |
| 2 192 202 | 1/1988 | United Kingdom . |

OTHER PUBLICATIONS

Textilpraxis International (1991) p. 1343 et seq. (Month Unknown).

*Primary Examiner*—Alan Diamond
*Attorney, Agent, or Firm*—Ernest G. Szoke; Wayne C. Jaeschke; Real J. Grandmaison

[57] ABSTRACT

The deposition of magnesium and calcium silicate in the bleaching of textiles with peroxides is prevented by contacting the textiles with a bleaching composition that is free from phosphorous and contains water-soluble polymers containing sulfonate and carboxylate groups, and polyhydroxymono- or dicarboxylates.

12 Claims, No Drawings

USE OF WATER-SOLUBLE POLYMERS AND POLYHYDROXYMONO- OR DICARBOXYLATES IN THE BLEACHING OF TEXTILES

This application is a 371 of PCT/EP95/01646 filed Apr. 29, 1995.

BACKGROUND OF THE INVENTION

1. Field of the Invention

This invention relates to the use of water-soluble, phosphorus-free polymers containing sulfonate and/or carboxylate groups and polyhydroxymono- or dicarboxylates for preventing the deposition of magnesium and calcium silicate in the bleaching of textiles with peroxides.

To make a natural yellow fiber, for example cotton, white, a pretreatment has to be carried out. One of the process steps is bleaching of the colored impurities ("yellow components"), normally by chemical oxidation.

In practice, hydrogen peroxide ($H_2O_2$) is used for chemical oxidation. Its relatively low potential enables it to be universally used in hot and cold processes in long-term and shock treatments without any significant problems in regard to machine corrosion and process safety. The critical agent in the "bleaching reaction" is the perhydroxyanion $HOO^-$ which is formed in known manner by self-dissociation of the $H_2O_2$ under alkaline conditions.

An unwanted competitive process is the self-decomposition of the $H_2O_2$ into radicals which attack not only the yellow components, but also the fibers and thus damage them.

The decomposition of $H_2O_2$ into radicals is catalyzed, for example, by the heavy metals always present in practice. These catalysts are very effectively inactivated by colloidal magnesium silicate which is formed by the addition of magnesium salts and soluble silicate (for example waterglass) to the bleach liquor. A disadvantage of stabilizing $H_2O_2$ by inorganic additives lies in the formation of poorly soluble alkaline earth metal silicates from the soluble silicate and the calcium/magnesium hardness emanating from the fibers (for example cotton).

The alkaline earth metal silicates accumulate as a deposit on machine parts and as an incrustation on the fibers. Complexing additives are used for colloidally stabilizing these alkaline earth metal silicates in the liquor ("threshold effect"). However, these additives have to be effective in less than stoichiometric quantities because otherwise the unwanted complexing dissolution and hence deactivation of the colloidal magnesium silicate will occur.

In addition to water, therefore, typical bleach liquors also contain hydrogen peroxide, alkali metal hydroxide, a water-soluble magnesium salt, a water-soluble alkali metal salt of a silicate, surfactants and a deposition inhibitor.

2. Discussion of Related Art

According to the prior art, the combination of alkali metal silicate with phosphonates or phosphonate combinations as deposition inhibitor results in the effective stabilization of peroxide in the bleach liquor and, at the same time, prevents deposits of alkaline earth metal silicate from forming on the hard surfaces of the machine parts.

EP-A-0 112 801 describes a combination of a magnesium complex of oligomeric phosphonic acid esters with an organic polyhydroxy compound, more particularly hydroxycarboxylic acids, as a stabilizer for hydrogen peroxide in bleach liquors. However, scaling on the bleaching apparatus and incrustations on the treated fibers can only be obtained by completely eliminating the silicates.

EP-A-0 210 952 describes the use of mixtures of a phosphorus-containing compound with a polyhydroxy compound, more particularly polyhydroxycarboxylic acids, for suppressing the decomposition of the per component in bleach liquors. Scaling on the bleaching apparatus and incrustations on the treated fibers can be avoided in this way despite the high percentage silicate content.

In "Textilpraxis international", 1991, pages 1343 et seq., U. Denter and E. Schollmeyer describe the influence of combinations of waterglass and polyhydroxycarboxylic acids on the stabilization of hydrogen peroxide in bleach liquors.

GB-A-2,192,202 describes a process for stabilizing bleaching solutions containing alkaline peroxide for textiles and paper pulps using poly-α-hydroxyacrylic acid salts.

DE-A-3 204 834 describes a process for bleaching knitted and woven fabrics with bleach liquor containing hydrogen peroxide using complexing agents based on polycarboxylic and polyhydroxycarboxylic acids in combination with magnesium salts as stabilizer.

However, bleach liquors incorporating phosphorus-containing components are to be banned in the future because of the pollution of the environment with phosphorus-containing compounds.

Accordingly, the problem addressed by the present invention was to provide phosphorus-free compounds which would avoid the formation of scale on machinery and incrustations on the treated fibers by alkaline earth metal silicates in the bleaching of textiles with peroxides. These compounds would match the phosphorus-containing compounds in performance, i.e. for the same quantity of active substance, a phosphorus-free additive of practical relevance would reduce deposits to the same extent as the phosphorus-containing additive. Preferably, these phosphorus-free compounds could also be biodegradable.

DESCRIPTION OF THE INVENTION

According to the invention, the problem stated above has been solved by the use of polymers containing sulfonate and/or carboxylate groups and polyhydroxymono- or dicarboxylates for preventing the deposition of magnesium and calcium silicate in the bleaching of textiles with peroxides.

As already mentioned, typical bleach liquors contain peroxide, more particularly hydrogen peroxide, alkali metal hydroxides, water-soluble magnesium salts, water-soluble alkali metal salts of a silicate, surfactants and the deposition inhibitor. In addition, the bleach liquors may also contain the usual additives, such as defoaming and/or deaerating agents and/or optical brighteners.

According to the invention, water-soluble polymers containing sulfonate and/or carboxylate groups and, optionally, additional nonionic groups are used as the phosphorus-free water-soluble deposition inhibitor.

Particularly suitable polymers containing sulfonate and/or carboxylate groups are those which contain units derived from two types of monomer, namely:

1. (meth)acrylic acid and salts thereof and 2. acrylamidoalkyl or acrylamidoaryl sulfonates.

In addition, a third type of monomer may be incorporated in the polymer derived from monomers of type 1. and/or 2. This third type of monomer may be at least one unit derived from vinyl esters, vinyl acetate or substituted acrylamides.

The monomers forming the polymer are characterized in that the units of (meth)acrylic acid and salts thereof have the following structural formula (A):

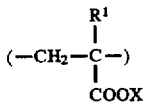

(A)

in which $R^1$ is hydrogen or a methyl group, X is hydrogen, a metal cation or $N—(R^2)_4$, where $R^2$ is hydrogen, a $C_{1-4}$ alkyl group, a $C_{1-4}$ hydroxyalkyl group or a mixture thereof;

in that the units of the acrylamidoalkyl or acrylamidoaryl sulfonates have the following structural formula (B):

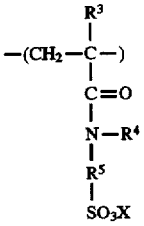

(B)

in which $R^3$ is hydrogen or a methyl group, $R^4$ is hydrogen or a $C_{1-4}$ alkyl group, $R^5$ is a $C_{1-8}$ alkyl or $C_{8-10}$ arylalkyl group and X is a group of the type defined for structural formula (A).

The above-mentioned nonionic monomer units which may optionally be present in the polymer are characterized in that the units of the vinyl esters have the following structural formula (C):

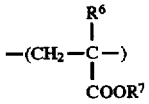

(C)

in which $R^6$ is hydrogen or a methyl group and $R^7$ is a $C_{1-6}$ alkyl group, a $C_{6-10}$ aryl group, a $C_{6-10}$ arylalkyl group or a group with the following structural formula:

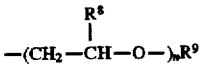

in which $R^8$ is hydrogen or a methyl group, $R^9$ is a $C_{1-6}$ alkyl group or hydrogen and n is an integer of 1 to 3;

in that the unit of the vinyl acetate has the following structural formula (D):

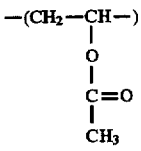

(D)

in that the units of the substituted acrylamides have the following structural formula (E):

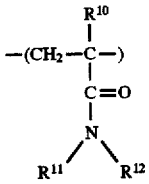

(E)

in which $R^{10}$ is hydrogen or a methyl group and $R^{11}$ and $R^{12}$ are each hydrogen, a $C_{1-8}$ alkyl group, a $C_{6-8}$ cycloalkyl group, a benzyl group or a group with the following structural formula:

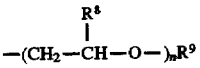

as defined for structural formula (C), so that $R^{11}$ and $R^{12}$ are not both hydrogen.

Preferred (meth)acrylic acids and salts are selected from acrylic acid, methacrylic acid and sodium salts thereof.

The preferred substituted acrylamidosulfonate is 2-acrylamido-2-methyl propane sulfonic acid while the preferred (alkyl)-substituted acrylamides are those of the hindered amines, tert.butyl acrylamide and dimethyl acrylamide. The preferred vinyl esters are ethyl acrylate, hydroxyethyl methacrylate, hydroxypropyl acrylate and cellosolve acrylate.

According to the invention, polymers containing 10 to 90% by weight of units derived from (meth)acrylic acid or from salts thereof and 90 to 10% by weight of acrylamidoalkyl or acrylamidoaryl sulfonate units, the polymers having a weight average molecular weight of 3,000 to 25,000, are preferred for use as the deposition inhibitor.

According to the invention, terpolymers or interpolymers containing between 10 and 84% by weight of units derived from (meth)acrylic acid or salts thereof, 11 to 40% by weight of acrylamidoalkyl or acrylamidoaryl sulfonate units and 5 to 50% by weight of one or more units selected from vinyl esters, vinyl acetate and substituted acrylamides, the polymers having a weight average molecular weight of 3,000 to 25,000, are also particularly suitable for use as the deposition inhibitor.

The units derived from (meth)acrylic add or salts thereof are preferably used in the polymers in a quantity of at least 30% by weight.

The weight average molecular weight of the polymers is preferably in the range from 4,000 to 8,000 and more preferably in the range from 4,500 to 5,500.

The most preferred terpolymer for the purposes of the invention is made up of 57% by weight of units of (meth) acrylic acid or salts thereof, 23% by weight of 2-acrylamido-2-methyl propane sulfonic acid and 20% by weight of a vinyl ester, vinyl acetate or alkyl-substituted acrylamide and has a weight average molecular weight of 4,500 to 5,500.

Particulars of the production of the terpolymers and interpolymers mentioned above can be found in U.S. Pat. No. 4,711,725.

The sodium or potassium salts of, in particular, gluconic acid, glucoheptonic acid, ascorbic acid or lactobionic acid or mixtures thereof are used as polyhydroxymonocarboxylates.

The sodium or potassium salts of, in particular, tartaric acid or glucaric acid are used as polyhydroxydicarboxylates.

The percentage content of deposition inhibitor (active substance) in the bleach liquor is between 0.01 and 0.2% by weight and preferably between 0.05 and 0.08% by weight.

Hydrogen peroxide in the form of a 30 to 50% by weight aqueous solution is preferably used as the peroxide.

Suitable alkali metal hydroxides are, above all, potassium hydroxide or, more particularly, the less expensive sodium hydroxide. Mixtures of potassium hydroxide and sodium hydroxide are also particularly suitable in regard to the homogeneity of the composition. The alkali metal hydroxide is preferably added to the bleach liquor in the form of an aqueous solution. Alkaline compositions are obtained by the addition of alkali metal hydroxide, the alkalinity of the compositions being determined by the concentration of alkali metal hydroxide.

Suitable water-soluble magnesium salts are, for example, the acetate, above all the sulfate or its heptahydrate and, in particular, the chloride or its hexahydrate. The magnesium salts are generally used as solids, solid magnesium sulfate heptahydrate being of particular interest.

The water-soluble alkali metal salt of a silicate may be, in particular, soda waterglass containing 24 to 28% by weight of $SiO_2$, above all in the form of an aqueous approximately 30 to 40% by weight solution. "Natronwasserglas 37/40" (a product of Henkel KGaA, Düsseldorf) containing 26.6 to 27% by weight of $SiO_2$ and 7.8 to 8.2% by weight of $Na_2O$ is particularly preferred.

Suitable surfactants (wetting agents) are both anionic and nonionic surfactants or mixtures thereof. Preferred anionic surfactants are, for example, alkane sulfonates, alkylaryl sulfonates, fatty acid condensates, proteolysis products or salts thereof and, above all, alkyl sulfate salts and alkyl benzene sulfonic acids containing 12 to 22 carbon atoms in the alkyl radical. Preferred nonionic surfactants are adducts of alkylene oxides, above all propylene and, in particular, ethylene oxide, and alkylphenols, for example containing 3 to 12 carbon atoms in the alkyl group, above all fatty acid amides and, in particular, fatty alcohols, adducts of ethylene oxide and fatty alcohols being particularly preferred and being of particular interest in the form of a mixture with the alkyl sulfates and alkane sulfates and the alkyl benzene sulfonic acids mentioned. Silicone surfactants and silicone oils are other suitable components for these mixtures.

Higher alcohols, for example isooctyl alcohol, and—for example—phosphoric acid esters may be used as defoaming and/or deaerating agents.

The textile material to be treated may be present in any of the various processing stages, for example as a loose material, yarn, woven or knitted fabric. In general, therefore, the textile material to be treated is always a textile material produced from pure cellulose textile fibers or from blends of cellulose textile fibers with synthetic textile fibers.

Suitable cellulosic fibers are, for example, those of regenerated cellulose, for example viscose staple fiber and viscose; those of native cellulose, for example hemp, linen, jute and, above all, cotton, while suitable synthetic fibers are those of polyacrylonitrile and, above all, those of polyester and polyamide.

Woven fabrics of cotton or regenerated cellulose or cotton/polyester blends and cotton/polyamide blends are particularly suitable for treatment in accordance with the invention, woven and knitted cotton fabrics being of particular interest. The actual peroxide bleaching process may be preceded by such preliminary processes as, for example, washing with surfactants, enzymatic desizing, alkaline scouring, causticization or mercerization and other bleaching treatments.

The application processes for the alkaline oxidative bleaching of cellulose-containing fiber materials with bleach liquors using the deposition inhibitors in accordance with the invention are carried out by methods known per se.

In the peroxide bleaching process (padding process) carried out continuously on an industrial scale, the impregnated fabric webs are first contacted with the bleach liquor (pad liquor) at a temperature of 10° to 40° C. The chemicals applied by this impregnation then act on the textile material, the contact time, the optionally elevated temperature and the concentration of chemicals being directly related and the selected conditions being dependent upon the characteristics of the fiber material and, above all, by the equipment available. The textile webs are then continuously washed at temperatures of 60° to 95° C.

However, the visible deposits produced by the alkaline earth metal silicate are formed to an increased extent on the first rollers, in the steamer (which is attributable to the particularly strong condensation and dilution effects occurring therein) and the first rollers of the first washing compartments. In principle, deposits are also formed on the fabric webs which can lead to feel problems. However, the webs pass through the installation only once while the deposits gradually accumulate on the machine parts. Compared with carbonate deposits, the alkaline earth metal silicate deposits are far less soluble so that the deposits of alkaline earth metal silicate on machine parts cannot readily be removed. In contrast to carbonate deposits, alkaline earth metal silicate deposits cannot readily be dissolved by adding an acid. In the case of silicate deposits, only the equally poorly soluble silica is formed in the dissolving process. For this reason, there is a considerable difference between alkaline earth metal carbonate and silicate deposits.

Accordingly, to evaluate the effectiveness of the deposition inhibitors, the formation of deposits on the first steamer roll was visually investigated and the coverage of the roll surface was classified as "clear" (no discernible deposits), "very lightly covered" (barely discernible deposits), "lightly covered" (distinctly discernible, but negligible deposits) and "covered" (distinctly discernible deposits).

To compare the phosphorus-containing deposition inhibitors of the prior art with the phosphorus-free additives used in accordance with the invention, the deposition-intensive process on the critical rolls of the process described above was compared for deposits.

The following Examples are intended to illustrate the invention without limiting it in any way.

Examples

Bleach liquor—standard composition per liter:

0.15 g $MgSO_4.7H_2O$, 15 ml waterglass "37/40" (a product of Henkel KGaA), 8 g sodium hydroxide, 7 ml Cottoclarin VK (mixture of anionic and nonionic surfactants), 3 ml Fuman L (mixture of anionic and nonionic surfactants), 40 ml hydrogen peroxide (35% by weight in water) and deposition inhibitor.

The addition of deposition inhibitor was gauged to produce a concentration of active substance of 0.01 to 0.2% by weight.

2 ml of a solution of a phosphonate combination (29% by weight) per liter of bleach liquor, corresponding to 0.058% by weight of active substance in the bleach liquor, was used as the phosphorus-containing deposition inhibitor.

The deposition of alkaline earth metal silicate on the first steamer roll after a test duration of 6 h was visually determined according to the criteria described above.

Where the above-mentioned formulation with no deposition inhibitor was used, the steamer roll was very heavily covered.

Where the above-mentioned formulation containing 2 ml of the phosphorus-containing deposition inhibitor was used, the roller was evaluated as "clear" under the conditions described above.

Use of deposition inhibitors according to the invention:

All tests using deposition inhibitors according to the invention were carried out under the conditions described above. The results are set out in the following Table:

TABLE

| Chemical Constitution | Molecular Weight | % By weight of Active Substance (% by Weight in the Bleach Liquor) | | Evaluation |
|---|---|---|---|---|
| Terpolymer containing carboxylate, sulfonate and nonionic groups | 4500 | 40 | (0.08) | Clear |
| Acrylic acid copolymer containing carboxylate and sulfonate groups | 4500 | 40 | (0.08) | Lightly covered |
| Anionic polymer | Low molecular weight | ca. 50 | (0.1) | Very lightly covered |
| Acrylic acid/methacrylic acid copolymer | 3000–4000 | 40 | (0.08) | Lightly covered |
| Acrylic acid/maleic acid copolymer | 7000 | 40 | (0.08) | Lightly covered |
| K glucarate | 248 | 100 | (0.08) | Very lightly covered |
| Na gluconate | 218 | 100 | (0.08) | Lightly covered |

What is claimed is:

1. The process of preventing the deposition of magnesium and calcium silicate in the bleaching of textiles with peroxides, comprising contacting said textiles with a bleaching composition that is free from phosphorous and contains water-soluble polymers containing sulfonate and carboxylate groups, and polyhydroxymono- or dicarboxylates.

2. A process as in claim 1 wherein said polymers containing sulfonate and carboxylate groups comprise units of (meth)acrylic acid and salts thereof having the structural formula (A):

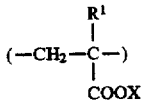

(A)

in which $R^1$ is hydrogen or a methyl group, X is hydrogen, a metal cation or $N—(R^2)_4$, where $R^2$ is hydrogen, a $C_{1-4}$ alkyl group, a $C_{1-4}$ hydroxyalkyl group or a mixture thereof; and units of acrylamidoalkyl or acrylamidoaryl sulfonates having the structural formula (B):

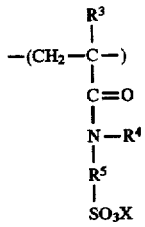

(B)

in which $R^3$ is hydrogen or a methyl group, $R^4$ is hydrogen or a $C_{1-4}$ alkyl group, $R^3$ is a $C_{1-8}$ alkylene or $C_{8-10}$ arylalkylene group and X is the same as defined for structural formula (A).

3. A process as in claim 1 wherein said polymers containing sulfonate and carboxylate groups comprise 10% to 90% by weight of units derived from (meth)acrylic acid or salts thereof and 90% to 10% by weight of units derived from acrylamidoalkyl or acrylamidoaryl sulfonate units, and have a weight average molecular weight of 3,000 to 25,000.

4. A process as in claim 1 wherein said polymers containing sulfonate and carboxylate groups additionally contain nonionic monomer units selected from vinyl esters, vinyl acetate and substituted acrylamides.

5. A process as in claim 4 wherein said vinyl esters have the structural formula (C):

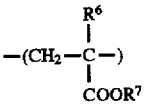

(C)

in which $R^6$ is hydrogen or a methyl group and $R^7$ is a $C_{1-6}$ alkyl group, a $C_{6-10}$ aryl group, a $C_{6-10}$ arylalkyl group or a group with the structural formula:

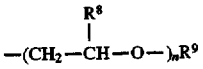

in which $R^8$ is hydrogen or a methyl group, $R^9$ is a $C_{1-6}$ alkyl group or hydrogen and n is an integer of 1 to 3;

said vinyl acetate has the structural formula (D):

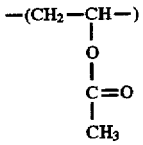

(D)

and said substituted acrylamides have the structural formula (E):

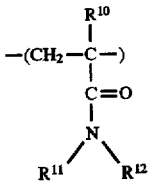

(E)

in which $R^{10}$ is hydrogen or a methyl group and $R^{11}$ and $R^{12}$ are each hydrogen, a $C_{1-6}$ alkyl group, a $C_{6-8}$ cycloalkyl group, a benzyl group or a group with the structural formula:

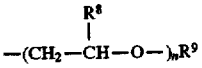

as defined for structural formula (C), with the proviso that $R^{11}$ and $R^{12}$ are not both hydrogen.

6. A process as in claim 4 wherein said polymers containing sulfonate and carboxylate groups comprise a terpolymer or interpolymer containing between 10% and 84% by weight of units derived from (meth)acrylic acid or salts thereof, 11% to 40% by weight of acrylamidoalkyl or acrylamidoaryl sulfonate units and 5% to 50% by weight of one or more units selected from vinyl esters, vinyl acetate and substituted acrylamides, said polymers having a weight average molecular weight of 3,000 to 25,000.

7. A process as in claim 6 wherein said polymers comprise greater than 10% up to 57% by weight of units of (meth) acrylic acid or salts thereof, 23% by weight of acrylamido-2-methyl propane sulfonic acid and 20% by weight of a vinyl ester, vinyl acetate or alkyl-substituted acrylamide.

8. A process as in claim 6 wherein said polymers have a weight average molecular weight of 4,000 to 8,000.

9. A process as in claim 1 wherein said polyhydroxymono-carboxylates are selected from the group consisting of sodium and potassium carboxylate of ascorbic acid and lactobionic acid.

10. A process as in claim 1 wherein said polyhydroxydi-carboxylates are selected from the group consisting of the sodium and potassium carboxylate of glucaric acid, gluconic acid, and tartaric acid.

11. A process as in claim 1 wherein said water-soluble polymers are present in said bleaching composition in an amount of between 0.01% and 0.2% by weight, based on the weight of said bleaching composition.

12. A process as in claim 1 wherein said polymers contain 10% to 90% by weight of units derived from (meth)acrylic acid or salts thereof, and 90% to 10% by weight of acrylamidoalkyl or acrylamidoaryl sulfonate units, said polymers having a weight average molecular weight of 3,000 to 25,000.

* * * * *